US005551123A

United States Patent [19]

Bartlett

[11] Patent Number: 5,551,123

[45] Date of Patent: Sep. 3, 1996

[54] HINGE ASSEMBLY

[75] Inventor: Derek Bartlett, Warwick, England

[73] Assignee: IHW Limited, Warwick, United Kingdom

[21] Appl. No.: 337,076

[22] Filed: Nov. 10, 1994

[30] Foreign Application Priority Data

Nov. 13, 1993 [GB] United Kingdom ..... 9323448.2
Oct. 14, 1994 [GB] United Kingdom ..... 9420582.0

[51] Int. Cl.[6] ..... E05D 7/10; E05D 11/10

[52] U.S. Cl. ..... 16/257; 16/334; 16/321; 16/344; 16/335

[58] Field of Search ..... 16/257, 334, 321, 16/319, 344, 325, 341, 335

[56] References Cited

U.S. PATENT DOCUMENTS 2,893,050 7/1959 Hollansworth ..... 16/335
4,332,055 6/1982 Rudnick et al. ..... 16/335
4,841,600 6/1989 Sasamura et al. ..... 16/335
5,218,738 6/1993 Krajenke ..... 16/334

FOREIGN PATENT DOCUMENTS 2085958 5/1982 United Kingdom ..... 16/335

*Primary Examiner*—M. Rachuba
*Assistant Examiner*—Adesh Bhargava
*Attorney, Agent, or Firm*—Jones & Askew

[57] ABSTRACT

A hinge assembly having a first hinge leaf pivotally connected to a second hinge leaf by first and second axially aligned pivotal connections, the first and second pivotal connections being axially spaced from one another, a first stop means located adjacent to the first pivotal connection and a second stop means located adjacent to the second pivotal connection, the first and second stop means being arranged to simultaneously limit pivotal displacement between the first and second hinge leafs at a fully open position.

12 Claims, 5 Drawing Sheets

HINGE ASSEMBLY

FIELD OF THE INVENTION

The present invention relates to a hinge assembly, in particular but not exclusively a lift-off hinge assembly for a vehicle.

BACKGROUND OF THE INVENTION

A hinge assembly having a pair of axially spaced hinge pins (commonly referred to as a twin pin lift off hinge) is described in our European Patent Specification 214468 and the hinge assembly of the present invention is particularly concerned with this type of hinge assembly.

According to one aspect of the present invention there is provided a hinge assembly having a first hinge leaf pivotally connected to a second hinge leaf by first and second axially aligned pivotal connections, the first and second pivotal connections being axially spaced from one another, a first stop means located adjacent to the first pivotal connection and a second stop means located adjacent to the second pivotal connection, the first and second stop means being arranged to simultaneously limit pivotal displacement between the first and second hinge leafs at a fully open position.

According to another aspect of the present invention there is provided a hinge assembly having a first hinge leaf pivotally connected to a second hinge leaf by a hinge pin, and a retention means for retaining the hinge leafs at a predetermined angular position, the retention means including a first latch formation connected to one hinge leaf so as to be rotationally fixed relative thereto and a second latch formation on the second hinge leaf, the first latch formation being biased toward the second hinge leaf so as to urge the first and second latch formations into engagement in said predetermined angular position, the first latch formation being removably mounted on the first hinge leaf.

Preferably the first latch formation is removably attached to the hinge pin. Preferably the first latch formation forms an integral part of a clip which is attachable to the hinge pin, the clip when attached to the hinge pin having a portion in abutment with the first hinge leaf to prevent rotation of the clip relative thereto.

According to a further aspect of the present invention there is provided a lift-off hinge assembly comprising a first hinge leaf hingedly connected to a second hinge leaf for relatively angular motion about a hinge axis, the first hinge leaf having a hinge pin fixedly mounted thereon and the second hinge leaf having a journal beating in which the hinge pin is received for rotation about said axis, the hinge pin being axially slidably received in the journal to enable axial separation of the first and second hinge leafs, removable stop means mounted on the hinge pin to prevent said axial separation, the second hinge leaf including a cam formation co-axially arranged with the hinge axis and having a cam face directed radially outwardly from said axis, the stop means including a cam follower means biased in a radially inward direction into contact with said cam face, the cam face and cam follower means co-operating to releasably retain the first and second hinge leafs at a predetermined angular position about said hinge axis.

Preferably the stop means comprises a body formed from a strip of resilient material, preferably spring steel.

The body is preferably cranked so as to form an anchorage portion which extends generally radially from said axis and a cam follower portion which extends generally parallel to said axis. Preferably the anchorage portion of the body is provided with an aperture through which the hinge pin passes, the location of the aperture from the cam follower portion being such that the body is placed under a resilient loading by reactive engagement between a rear wall portion of the aperture on the hinge pin and between the cam follower portion on the cam face.

Preferably the hinge pin is provided with a groove, preferably an annular groove, in which the anchorage portion is seated. The aperture is formed so as to be of a larger diameter than the shank of the hinge pin to enable it to be easily slid axially along the shank of the hinge pin.

Preferably, the rear wall portion of the aperture is formed so as to define a rigid shoulder ie. it defines a shoulder which prevents the anchorage portion from being pulled radially off the hinge pin.

The provision of the rigid shoulder enables a high resilient loading to be applied between the cam follower and cam face for holding the hinge leafs at said predetermined angular position.

Preferably the body co-operates with an abutment on the first hinge leaf to prevent relative rotation between the body and the first hinge leaf about said axis.

In one embodiment the aperture in the anchorage portion is continuously walled and a release ear is preferably formed on the anchorage portion on the opposite side of the hinge pin to the cam follower portion, the release ear providing a purchase location for gripping of the anchorage portion to enable it to be moved radially inwardly against said resilient loading to remove the rear wall portion of the aperture from said groove and thereby enable the body to be axially removed from the hinge pin.

In another embodiment, the anchorage portion is provided with an end portion located on the opposite side of the hinge pin to the cam follower portion, the end portion including a slit communicating with the aperture, which divides the end portion to define a pair of arms, each arm including a gripping formation to enable the arms to be gripped and spread apart to enlarge the aperture and enable the anchorage portion to be removed from the hinge pin. The cam face may include a recess or flat for co-operation with the cam follower portion for defining said predetermined position.

Various aspect of the present invention are hereinafter described with reference to the accompanying drawings, in which:

DESCRIPTION OF THE PREFERRED EMBODIMENTS

Figure 1:
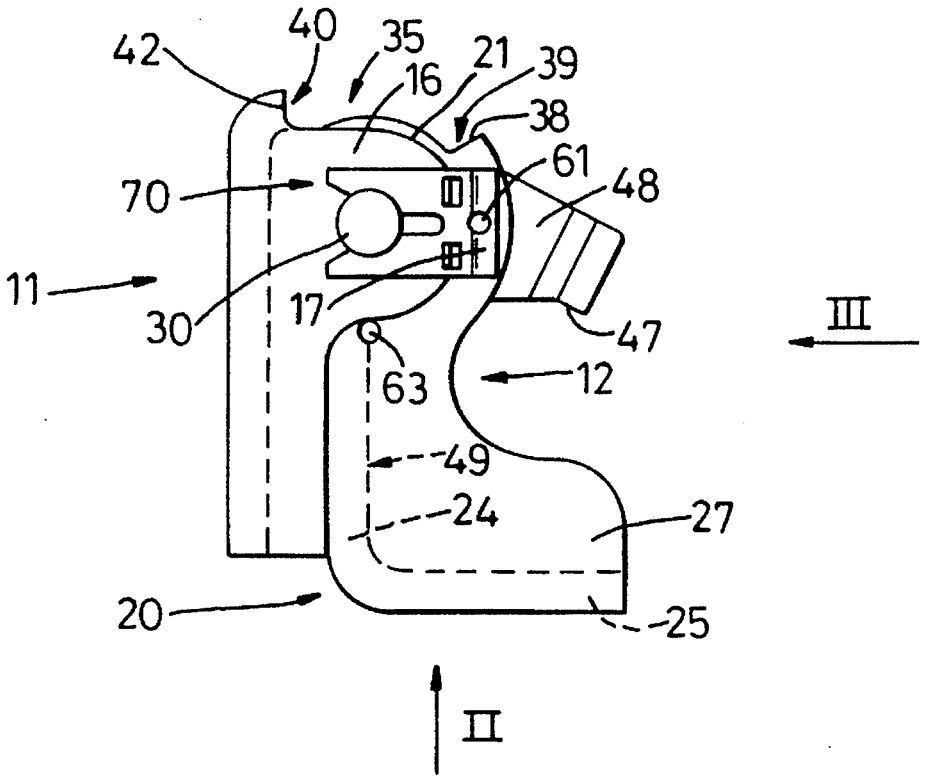
FIG. 1 is a plan view of a first embodiment according to the present invention.
Figure 2:
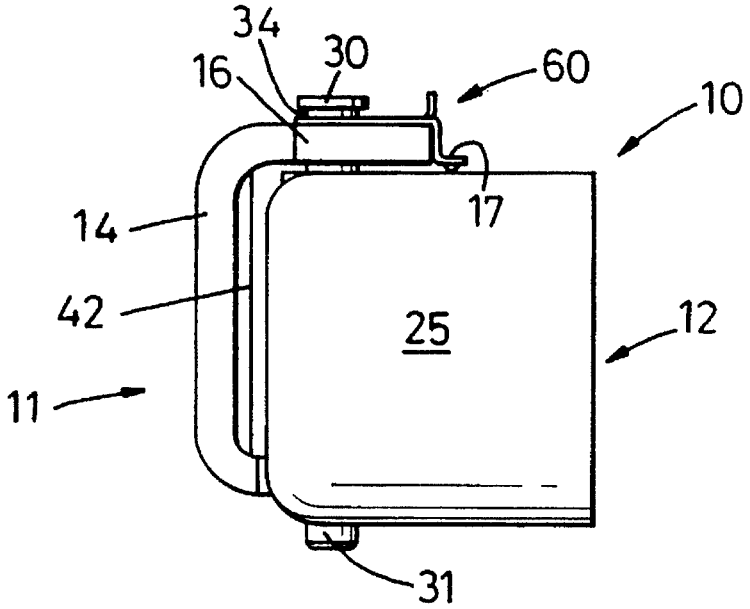
FIG. 2 is a side view of the embodiment shown in FIG. 1 when viewed in the direction of arrow II.
Figure 3:
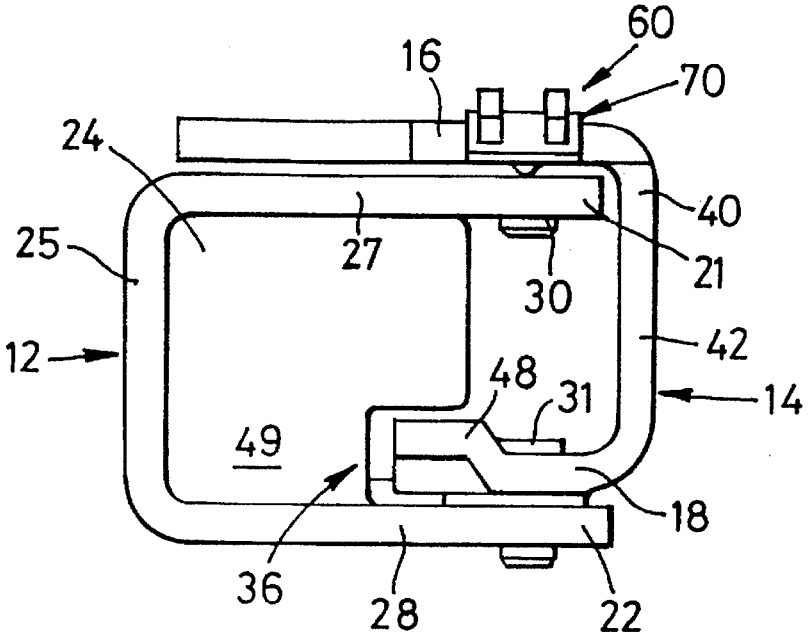
FIG. 3 is a side view of the embodiment shown in FIG. 1 when viewed in the direction of arrow III.

Referring initially to FIGS. 1–3, there is shown a vehicle door lift-off hinge assembly 10 comprising a door hinge leaf 11 pivotally connected to a body hinge leaf 12. The door hinge leaf 11 is intended to be mounted on the vehicle door (not shown) and the body hinge leaf 12 is intended to be mounted on the vehicle body (not shown).

SUMMARY OF THE INVENTION

Hinge leaf 11 is preferably a metal pressing which is formed so as to have a planar main body portion 14 for attachment to the vehicle door, the body portion 14 including an upper arm 16 and lower arm 18 projecting laterally therefrom. In use the outer face of the main body portion 14 resides in face to face contact with a wall of the vehicle door and is secured thereto in a conventional manner.

Similarly hinge leaf 12 is preferably a metal pressing which is formed so as to have a main body portion 20 including an upper arm 21 and lower arm 22 projecting laterally therefrom. As seen in FIG. 1, the main body portion 20 is cranked having a first cranked portion 24 and second cranked portion 25; both portions 24 and 25 being planar. In use cranked portion 25 is arranged to be in face to face contact with the body of the vehicle and is secured thereto by conventional means.

Preferably the upper and lower arms 21,22 are formed as part of an upper and lower flange 27,28, respectively, which extend along the upper and lower edges of the main body portion 20 to thereby define a strong box-like structure.

A pair of axially aligned hinge pins 30,31 are provided for creating a pivotal connection between adjacent upper arms 16,21 and adjacent lower arms 18,22.

As shown, hinge pin 30 is fixedly mounted in upper arm 21 and projects upwardly to pass through a journal (not shown) formed in upper arm 16, whereas hinge pin 31 is fixedly mounted in lower arm 18 and projects downwardly to pass through a journal (not shown) formed in the lower arm 22. The journals may be defined by a METALOPLAST (RTM) bush.

The hinge assembly 10 is provided with a pair of stop formations 35,36 which simultaneously act to limit the pivotal movement of the hinge leafs when moving in the door opening direction. Stop formation 35 is located adjacent to the upper pivotal connection between upper arms 16 and 21 and comprises an abutment face 38 on leaf 12 defined by a shoulder 39 formed in arm 21 which co-operates with an abutment face 40 on leaf 11 which is defined by a side wall 42 of the main body portion 14.

Stop formation 36 is located adjacent to the lower pivotal connection between lower arms 18,22 and comprises an abutment face 47 on leaf 11 which co-operates with an abutment face 49 on leaf 12 defined by the internal face of first cranked portion 24.

The abutment face 47 is formed on a stop arm 48 which is an extension of lower arm 18.

The hinge assembly 10 is shown in FIG. 1 in the closed position and in this position, the co-operating abutment faces of stop formations 35,36 are spaced apart. When the hinge leafs 11,12 are pivotally moved to the fully opened position determined by stop formations 35,36, the co-operating abutment faces 38,40 and 47,49 mutually and simultaneously abut. Accordingly loads are simultaneously applied at the top and bottom of the hinge assembly and twisting forces on the body portions 14,20 are minimised. In view of this, the gauge of the metal from which the hinge leafs are pressed can be minimised. Preferably the metal sheet from which the leafs 11,12 are made in steel and the thickness (i.e. gauge) of the material is preferably between 2.5 to 5.5 mm: preferably about 3 to 4 mm.

Reduction in the thickness of the sheet metal from which the hinge leafs 11,12 is made also has the advantage of reducing the amount of axial displacement necessary between the hinge leafs 11,12 in order to achieve separation of the leafs when demounting the door.

During manufacture of a vehicle it is common practice for the vehicle to travel along a production line with its doors fully open to enable personnel to gain easy access to both the interior of the vehicle body or the inside face of the door.

During such movement along the production line it is desirable for the doors to be releasably held in its fully open position in order to prevent it from closing unintentionally.

According to another aspect of the present invention the hinge assembly 10 is provided with a hinge retention means 60 which acts to hold hinge leafs 11,12 at their fully open position. The retention means 60 also acts as a stop to prevent axial separation of the hinge leafs.

The hinge retention means 60 includes a latch formation in the form of a projection 61 which is rotatably fixed to hinge leaf 11 and which is biased in an axial direction to engage against the upper surface of arm 21.

Arm 21 is provided with a co-operating latch formation in the form of a recess 63 adapted to receive projection 61. Accordingly when hinge leafs 11,12 are moved toward their fully open position the projection 61 rides along the upper surface of arm 21 and eventually enters recess 63 and is held therein under the axial bias. The projection 61 is shaped so as to be capable of tiding out of the recess. Thus if closing force on the hinge leafs in excess of the holding force of the projection is made, the hinge leafs 11,12 may be moved toward their closed position. Accordingly a door can be intentionally opened to and closed from its fully open position many times without affecting the efficiency of operation of the retention means 60, in holding the door at its fully open position.

Preferably the projection 61 is formed integrally with a clip 70 which preferably is metal pressing formed from spring steel.

The clip 70 has a main body 71 having a pair of arms 72 defining therebetween a recess 73 having an access mouth 73*a*. In use the main body 71 is seated on hinge pin 30 by virtue of arms 72 being located within an annular groove 34 formed on pin 30.

A flange 74 depends downwardly from the main body 71 and carries at its terminal and a laterally extending flange 75 in which the projection 61 is formed.

The distance between the bottom of projection 61 and body 71 is chosen to be greater than the distance between the upper face of arm 21 and the upper face of arm 16 so as to cause the portion of the body 71 between pin 30 and flange 74 to resiliently bend and thereby create the axial bias on projection 61 as it rides across the upper surface of arm 21.

Flange 74 co-operates with arm 16 in order to prevent the clip 70 from rotating relative to hinge leaf 11. In this respect, the arm 16 is preferably provided with a flat portion 17 on its edge against which a face of flange 74 abuts. The flat portion 17 may be formed in a recess if desired.

During use, recess 73 holds the clip 70 on the pin 30 to prevent its removal radially of the pin.

In order to enable easy removal of the clip 70, a pair of ears 78 are formed in the body 71. To withdraw the clip 70, the door is opened to permit access to the clip 70, the ears 78 are gripped by a tool and the clip body 71 is then drawn radially from the pin 30. After removal the door may be demounted or the clip 70 may be replaced by a different clip not having a projection 61.

It is envisaged that the recess 63 may be located at an intermediate position between the fully open and closed position and that more than one recess 63 may be provided to provide a plurality of positions at which the door may be releasably held.

It is also envisaged that as an addition or as an alternative a clip 70 may be mounted on hinge pin 31.

It is also envisaged that the retention means 60 may be incorporated into a hinge assembly having a single hinge pin.

Further embodiments are illustrated in FIGS. 5 to 11 wherein parts similar to those in the first embodiment have been designated by the same reference numerals. In the second and third embodiments the construction of the hinge leafs 11 and 12 is the same as for the first embodiment with the exception that the hinge retention means 60 is located on hinge pin 31 instead of hinge pin 30 and hinge pin 30 is fixedly mounted on arm 16 instead of arm 21.

In the embodiment of FIGS. 5 to 9, the retention means 60 includes a unitary stop body 123 formed from a strip of resilient material such as spring steel. The strip is cranked to define an anchorage portion 124 which extends generally radially of the hinge pin 31 and a cam follower portion 128 which extends generally parallel to the axis of the hinge pin 31.

The anchorage portion 124 is formed with an aperture 125 through which the shank of the hinge pin 31 passes. Preferably the size of the aperture 125 is greater than the diameter of the hinge pin shank to enable the anchorage portion 124 to be easily slide axially along the hinge pin. A seat for retaining the anchorage portion 124 on the hinge pin is provided, preferably in the form of an annular groove 126.

The terminal end portion of the arm 22 is formed to define a cam 150 having an axis co-axial with the hinge pin and having a radially outwardly facing cam face 151.

The cam follower portion 128 includes a projection 130 and the cam face 151 includes a recess 131.

The aperture 125 is located on the anchorage portion 124 at a distance from the cam follower portion 128 such that the rear wall portion 125*a* of the aperture is resiliently urged into contact with the hinge pin and the cam follower 128 is resiliently urged into contact with the cam face 151.

In use, when the hinge leafs 11 and 12 are moved about the hinge axis the projection 130 rides along the cam face 151 and at a predetermined angular position enters the recess 131.

The projection 130 is urged to be retained in the recess 131 by the resilient loading within the body of the stop body 123 and is preferably shaped so it can ride out of the recess 131 under a predetermined load applied circumferentially along the cam face 151. Thus, if a closing force is applied to the hinge leafs in excess of the predetermined load, the projection 130 will ride out of the recess 131, allowing the hinge leafs to move into a closed position.

Accordingly, the stop body 123 and cam 50 co-operate to define retention means for holding the hinge leafs at a predetermined angular position.

Figure 4:
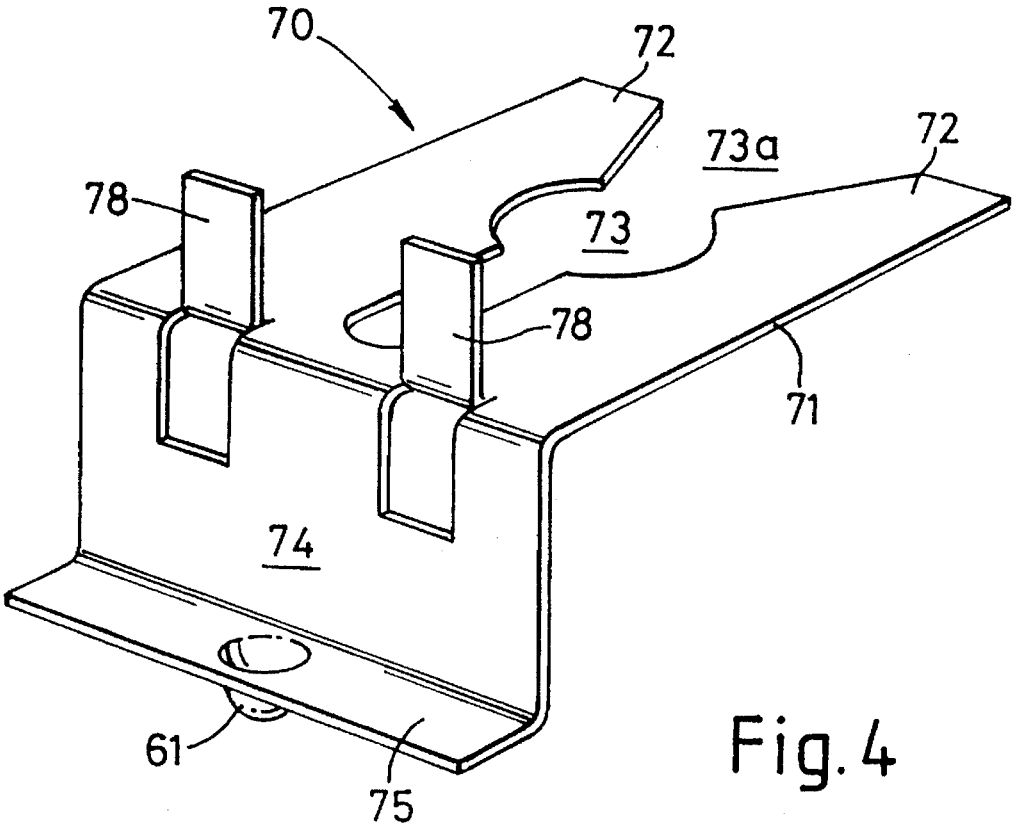
FIG. 4 is an enlarged perspective view of a spring clip used in the embodiment of FIG. 1.
Figure 5:
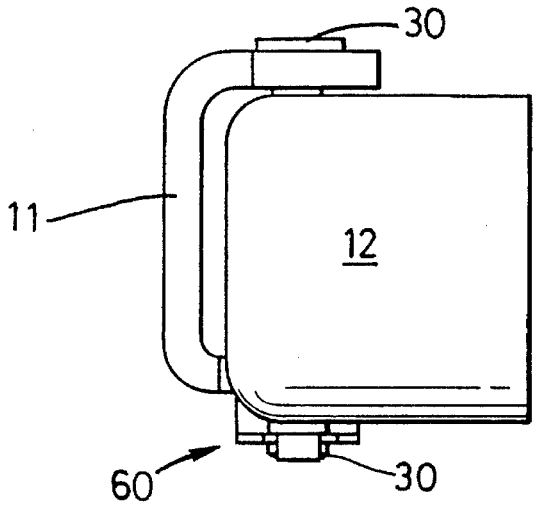
FIG. 5 is a front view of a hinge according to a second embodiment of the invention.
Figure 6:
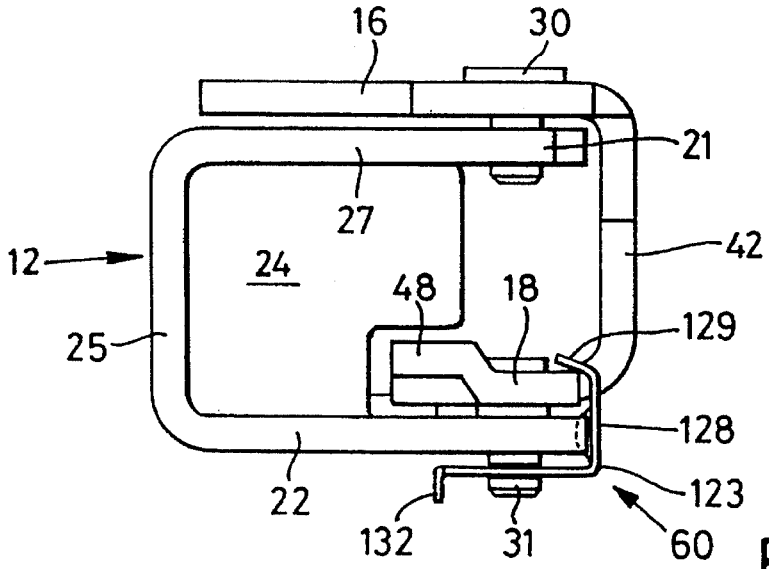
FIG. 6 is a side view of a hinge of FIG. 5.
Figure 9:
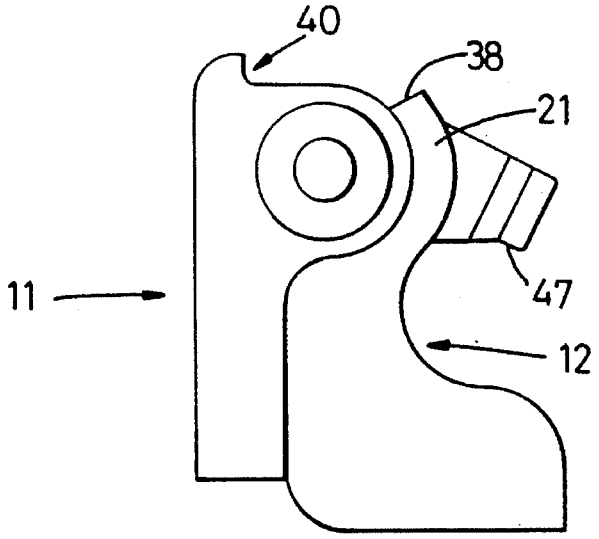
FIG. 9 is a plan view from above showing the movement of the hinge leaf.
Figure 7:
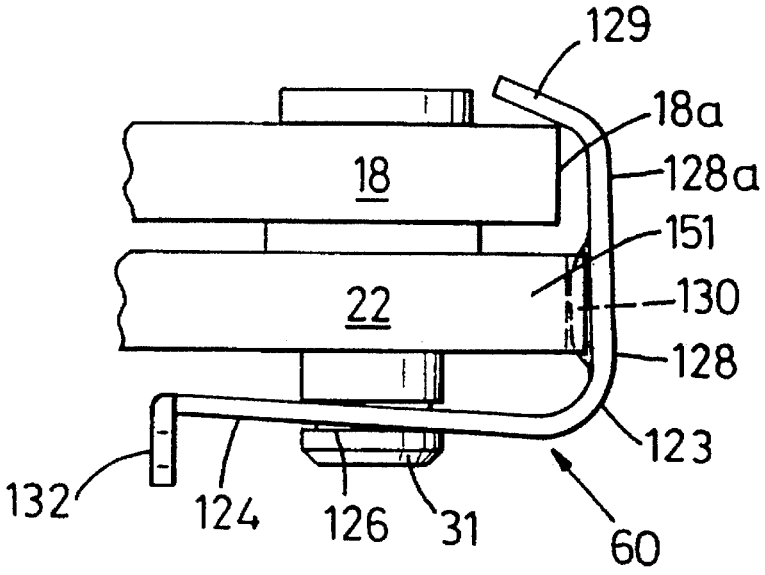
FIG. 7 is an enlarged view of a portion of FIG. 6 showing the stop means.
Figure 8:
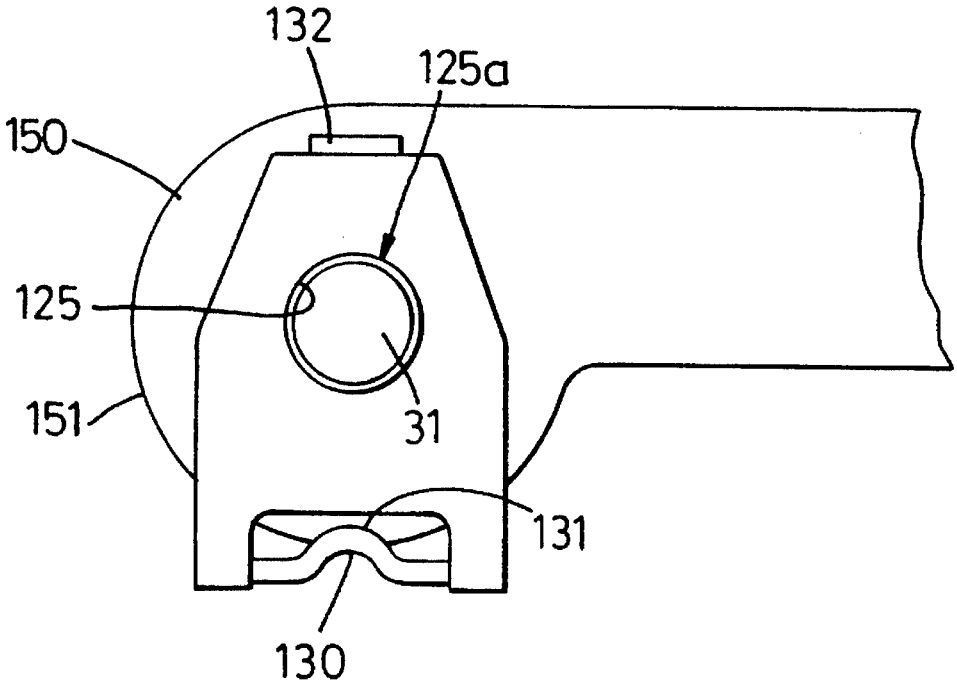
FIG. 8 is a plan view from below of the portion shown in FIG. 7.

As shown, the end of the cam follower portion 128 includes a terminal flange formation 129 which extends generally radially inwards to overlie an upper surface of the lower arm 18. The terminal flange formation 129 is provided to act as a stop formation to prevent clockwise pivoting of the stop body 123 (as seen in FIG. 4) which could result in unintentional removal of the stop body 123 from the hinge pin.

It will be appreciated that as the hinge leafs move about the hinge axis, the cam follower 128 will move from a radially outer position to a radially inner position when it enters the recess 130.

The flange portion 129 has a sufficient radial dimension to enable the portion 129 to maintain an overlying relationship with the arm 18 at the position of maximum radial outward displacement of the cam follower portion 28 when riding on the cam face 151.

As shown, a release ear 132 is formed at the end of the anchorage portion 124. By pulling on the ear 132 (in a direction to the left in FIG. 3), the aperture 125 can be lifted out of the groove 126, allowing the stop body 123 to be removed axially from the hinge pin 31.

Preferably the formation 129 is inclined at an obtuse angle relative to the cam follower portion 128 to provide, in co-operation with arm 18, a fulcrum about which the body stop 123 may be pivoted on pulling ear 132. Such a feature facilitates removal of the stop body 123 from the hinge pin.

It will be appreciated that the recess 131 may at any desired intermediate angular position between the fully open and closed positions of the hinge leafs, and that more than one recess 13 1 may be provided to provide a plurality of positions at which the door may be held releasably.

Additionally, or alternatively, a stop body 123 according to the invention may be mounted on hinge pin 32 in which case a cam 150 would be provided on arm 21.

In order to prevent the stop body 123 from rotating about the hinge pin 31 an upper portion 128a of the cam follower 128 is arranged to abut against a flat face 18a formed on the arm 18.

Figure 10:
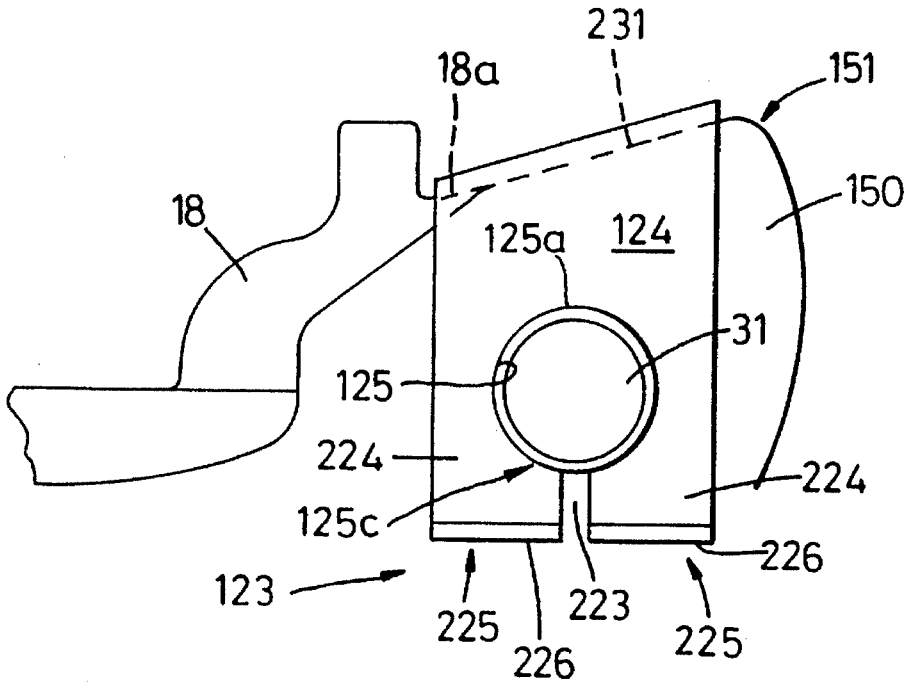
FIG. 10 is a plan view from below similar to FIG. 8 of a third embodiment according to the present invention.
Figure 11:
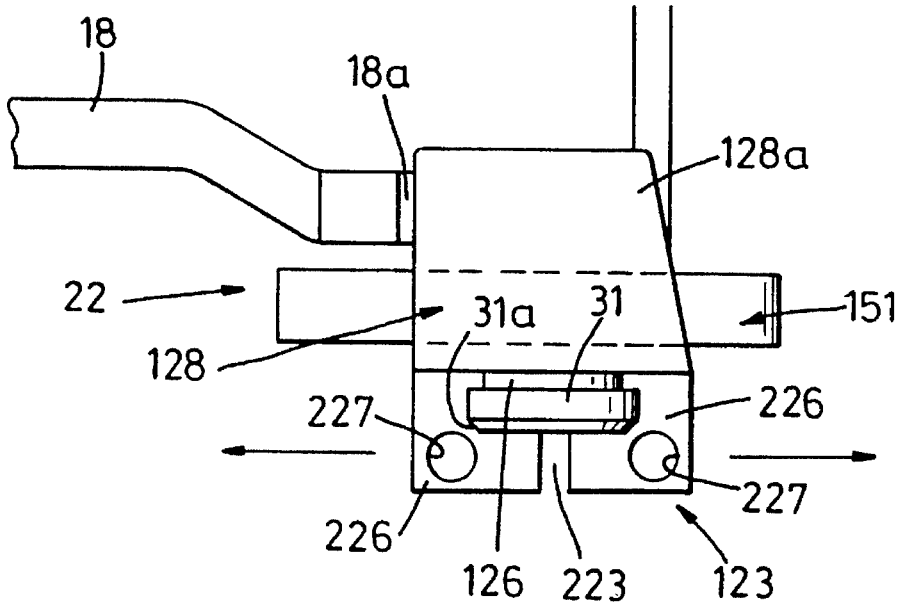
FIG. 11 is a side view of the embodiment shown in FIG. 10.

A third embodiment is illustrated in FIGS. 10 and 11. Parts similar to the second embodiment have been designated by the same reference numerals.

The assembly shown in FIGS. 10 and 11 differs from the second embodiment in that the recess 131 on the cam face 151 has been replaced by a flat 231 which is preferably of a length substantially equal to the width of the cam follower portion 128. The projection 130 is omitted and instead the cam follower portion 128 resides in face to face contact with the flat 231 to retain the hinge leafs at the predetermined angular position.

In the third embodiment the aperture 125 is of a diameter which is slightly less than the diameter of the shank of the pin 31.

A slit 223 is formed in an end portion of the anchorage portion 124 to define a pair of arms 224 which preferably include gripping formations 225 in the form of cranked arm portions 26 having apertures 27 into which a tool (not shown) such as pliers may be inserted for moving the arms 224 apart.

Such movement causes the aperture 125 to be enlarged and therefore enables the stop body 123 to be removed from the hinge pin 31. The gauge of the resilient strip and the material is preferably chosen to enable relatively easy spreading of arms 224 without detracting from the rear wall portion's 125*a* ability to act on a rigid stop.

Location of the stop body 123 onto the hinge pin 31 is preferably achieved by sliding the aperture 125 along the hinge pin and into the groove 126. Enlargement of the aperture 125 to achieve sliding along the hinge pin 31 is preferably achieved by providing the terminal end of the hinge pin with a chamfered face 31*a* which acts as a cam to enlarge the aperture 125 as the anchorage portion 124 is pushed axially onto the hinge pin.

The groove 126 has side walls which are flat and perpendicular to the hinge axis and so once the anchorage portion 124 is seated in the groove 126 it cannot be removed by the application of axially directed pressure.

Accordingly, the flange portion 129 may be omitted from the third embodiment.

It will be appreciated that the retention means of the invention could be included in a hinge assembly having a single hinge pin only.

I claim:

1. A hinge assembly having a first hinge leaf pivotally connected to a second hinge leaf by first and second axially aligned pivotal connections, the first and second pivotal connections being axially spaced from one another, a first stop means located adjacent to the first pivotal connection and a second stop means located adjacent to the second pivotal connection, the first and second stop means being arranged to simultaneously limit pivotal displacement between the first and second hinge leafs at a fully open position, the first and second hinge leafs each being in the form of metal pressings and each leaf including a main body portion from which a pair of arms laterally project, a first adjacent pair of arms of the respective leafs being connected by said first pivotal connection and a second adjacent pair of arms of the respective leafs being connected by said second pivotal connection, the first stop means being defined by an abutment formed on an arm of the first hinge leaf and a co-operating abutment formed on the body portion of the second hinge leaf, and the second stop means being defined by an abutment formed on an arm of the second hinge leaf and a co-operating abutment formed on the main body portion of the first hinge leaf, the abutment formed on the arm of the second hinge leaf is defined by an abutment face formed on an extension of said arm.

2. A hinge assembly according to claim 1 wherein each of the first and second pivotal connections is defined by a hinge pin fixedly mounted on one hinge leaf and a journal bearing formed on the other hinge leaf which rotatably receives the hinge pin, the hinge pin being axially slidably received in the associated journal bearing to enable axial separation of the first and second hinge leafs, and removable stop means mounted on at least one of the hinge pins to prevent axial separation.

3. A hinge assembly according to claim 2 wherein said hinge leaf including the associated journal in which said hinge pin is rotatably received includes a cam formation co-axially arranged with the hinge axis and having a cam face directed radially outwardly from said axis,, the stop means including a cam follower means biased in a radially inward direction into contact with said cam face, the cam face and cam follower means co-operating to releasably retain the first and second hinge leafs at a predetermined angular position about said hinge axis.

4. A hinge assembly according to claim 1 wherein the co-operating abutment formed on said body of the first hinge leaf is defined by an inner side face of said main body of said first hinge leaf.

5. A hinge assembly according to claim 4 wherein the abutment formed on said arm of the first hinge leaf is defined by a shoulder.

6. A hinge assembly according to claim 5 wherein the co-operating abutment formed on said main body of the second hinge leaf is defined by a side wall of said main body portion of the second hinge leaf.

7. A hinge assembly according to claim 1 wherein the gauge of metal for forming both hinge leafs is between 2.5 to 5.5 mm.

8. A hinge assembly according to claim 7 wherein the gauge of metal for forming both hinge leafs is between 3 to 4 mm.

9. A hinge assembly having a first hinge leaf pivotally connected to a second hinge leaf by a hinge pin, and a retention means for retaining the hinge leafs at a predetermined angular position, the retention means including a first latch formation connected to one hinge leaf so as to be rotationally fixed relative thereto and a second latch formation on the second hinge leaf, the first latch formation being biased toward the second hinge leaf so as to urge the first and second latch formations into engagement in said predetermined angular position, the retention means being removably mounte don the first hinge leaf.

10. A hinge assembly according to claim 9 wherein the retention means comprises a spring clip removably mounted in a groove formed on said hinge pin.

11. A lift-off hinge assembly comprising a first hinge leaf hingedly connected to a second hinge leaf for relatively angular motion about a hinge axis, the first hinge leaf having a hinge pin fixedly mounted thereon and the second hinge leaf having a journal bearing in which the hinge pin is received for rotation about said axis, the hinge pin being axially slidably received in the journal to enable axial separation of the first and second hinge leafs, removable stop means mounted on the hinge pin to prevent said axial separation, the second hinge leaf including a cam formation co-axially arranged with the hinge axis and having a cam face directed radially outwardly from said axis, the stop means including a cam follower means biased in a radially inward direction into contact with said cam face, the cam face and cam follower means co-operating to releasably retain the first and second hinge leafs at a predetermined angular position about said hinge axis.

12. A hinge assembly according to claim 11 wherein the removable stop means comprises a spring clip removably mounted in a groove formed on said hinge pin.

* * * * *